US008544122B2

(12) United States Patent
Slot

(10) Patent No.: US 8,544,122 B2
(45) Date of Patent: Oct. 1, 2013

(54) PLUNGER DEVICE

(76) Inventor: Franchot Slot, Gig Harbor, WA (US)

( * ) Notice: Subject to any disclaimer, the term of this patent is extended or adjusted under 35 U.S.C. 154(b) by 0 days.

(21) Appl. No.: 13/421,954

(22) Filed: Mar. 16, 2012

(65) Prior Publication Data

US 2012/0233757 A1 Sep. 20, 2012

Related U.S. Application Data

(60) Provisional application No. 61/454,000, filed on Mar. 18, 2011.

(51) Int. Cl.
*E03D 9/00* (2006.01)

(52) U.S. Cl.
USPC ..... 4/255.05

(58) Field of Classification Search
USPC ..... 4/255.01–255.12
See application file for complete search history.

(56) References Cited

U.S. PATENT DOCUMENTS

| | | | | |
|---|---|---|---|---|
| 2,817,080 | A * | 12/1957 | Balduman | 340/395.1 |
| 4,458,368 | A * | 7/1984 | Webb | 4/255.11 |
| 4,622,702 | A * | 11/1986 | Allen | 4/255.12 |
| 4,768,237 | A | 9/1988 | Torti | |
| 5,706,528 | A | 1/1998 | Broback | |
| 6,192,525 | B1 | 2/2001 | Tash | |
| 6,216,283 | B1 | 4/2001 | Tash | |
| 6,510,860 | B2 * | 1/2003 | Kihs | 134/166 C |
| 6,859,949 | B1 | 3/2005 | Gavin | |
| 6,898,807 | B2 | 5/2005 | Tash | |
| 7,213,273 | B2 | 5/2007 | Wang | |

* cited by examiner

*Primary Examiner* — Lori Baker
(74) *Attorney, Agent, or Firm* — Buckingham Doolittle & Burroughs, LLP

(57) ABSTRACT

An improved toilet plunger for unclogging drains, such as those typically associated with a toilet, preferably comprised of a stem, a bell with a generally oblong opening, and a plurality of baffles attached to said bell. The unique shape of the bell and bell opening, combined with the presence and function of the baffles, make the improved plunger device particularly effective for unclogging modern trough-like toilet drains.

18 Claims, 5 Drawing Sheets

PLUNGER DEVICE

CROSS-REFERENCE

This application claims priority from Provisional Patent Application Ser. No. 61/454,000 filed on Mar. 18, 2011.

FIELD OF THE INVENTION

This invention relates to a plunger device for unclogging drains, such as those associated with toilets, comprised of an improved bell design. In a preferred embodiment, the improved plunger device further comprises at least one baffle for increasing the effectiveness of the device.

BACKGROUND

Plungers are well known in the art for unclogging drains such as those associated with a toilet. However, while toilet and drain designs have improved over the years, the same cannot be said of the technology associated with the plunger. Traditional shaped plungers, with a generally circular bell opening, are not particularly effective on most modern day toilets because of their trough-like drains. More specifically, traditionally shaped plunger bells are ineffective because they are typically incapable of achieving the necessary seal around the drain opening or trough due to their shape. An improper seal between the plunger bell and the toilet drain may result in the inverting of the traditionally shaped plunger bell and/or waste contaminated water being splashed out of the toilet bowl and onto the user when the plunger bell is compressed, both of which are highly undesirable and can be frustrating for the user.

Moreover, a user that is unable to unclog a drain with a plunger may have to resort to calling a plumber, which can be expensive, or the use of more expensive and complicated plumbing tools such as drain snakes, roto-rooters and other drain cleaning devices. Further, the repeated use of these types of devices can be both costly and may cause damage to the toilet and/or the drain, which could lead to even more costly repairs and/or the need to replace the toilet, the drain and/or the associated plumbing.

Consequently, there exists in the art a long-felt need for an improved plunger device for unclogging drains, particularly those associated with modern day toilets and trough-like drains. Additionally, there is a long-felt need for an improved plunger device that enables the user to create the appropriate seal between the plunger bell and the drain to maximize or increase the effectiveness of the plunger device, and to reduce the likelihood of splash-back or that the user will have to resort to more expensive and time consuming repairs. Finally, there is a long-felt need for an improved plunger device that accomplishes all of the forgoing objectives and that is relatively easy and inexpensive to manufacture and use.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one aspect thereof, comprises a stem and a plunger bell. Further, the bell is preferably comprised of a dome, a base, and a generally oblong bell opening. In a preferred embodiment of the present invention, the improved plunger device further comprises at least one, and preferably more than one, flap or baffle attached to said dome. Said baffles are capable of dropping below or hanging down from said dome or base to improve the seal between the bell and the drain.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

DETAILED DESCRIPTION

Figure 1:
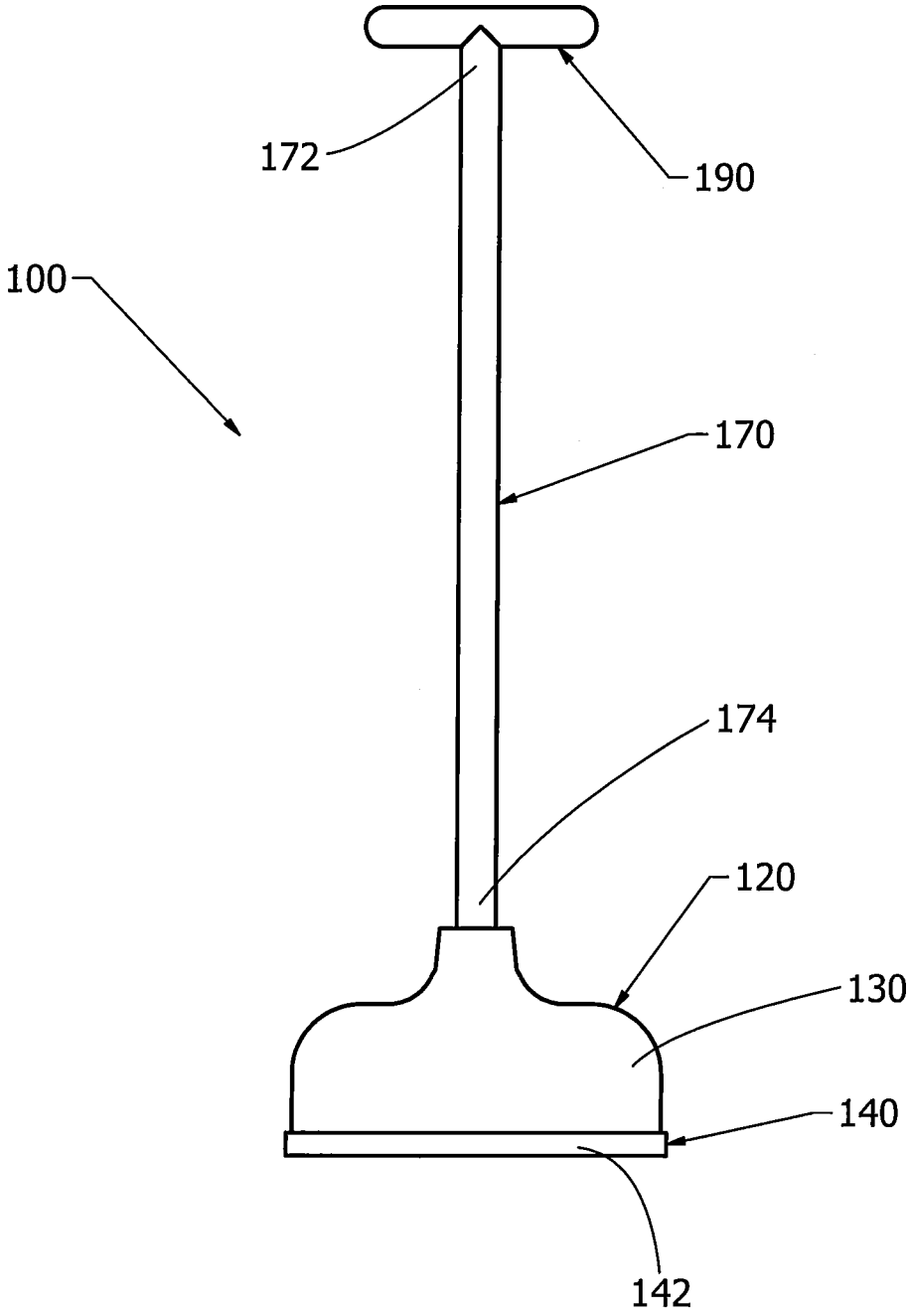
FIG. 1 illustrates a front elevational view of one embodiment of the improved plunger device of the present invention.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details.

Figure 2:
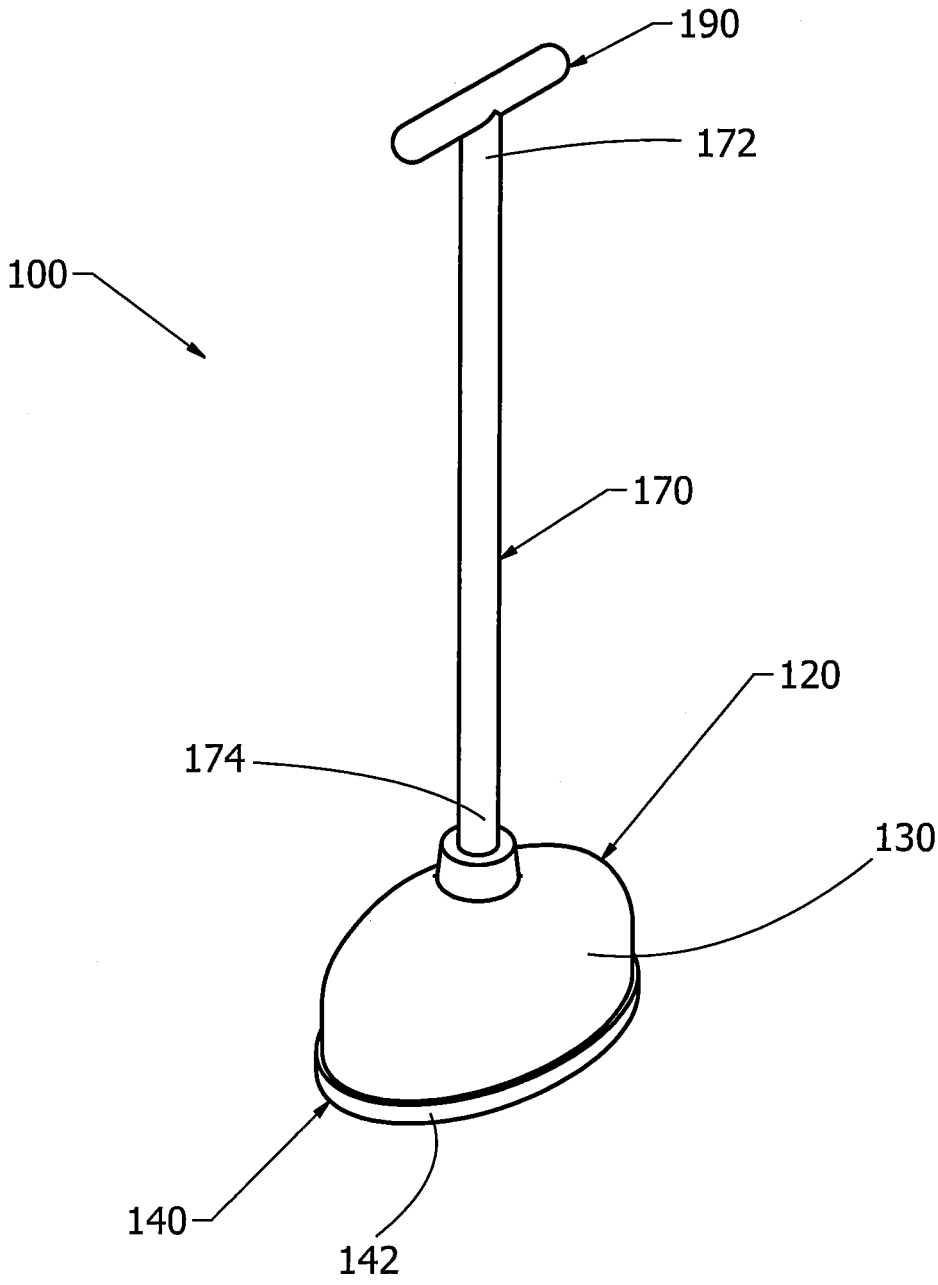
FIG. 2 illustrates a perspective view of the improved plunger device depicted in FIG. 1.
Figure 3:
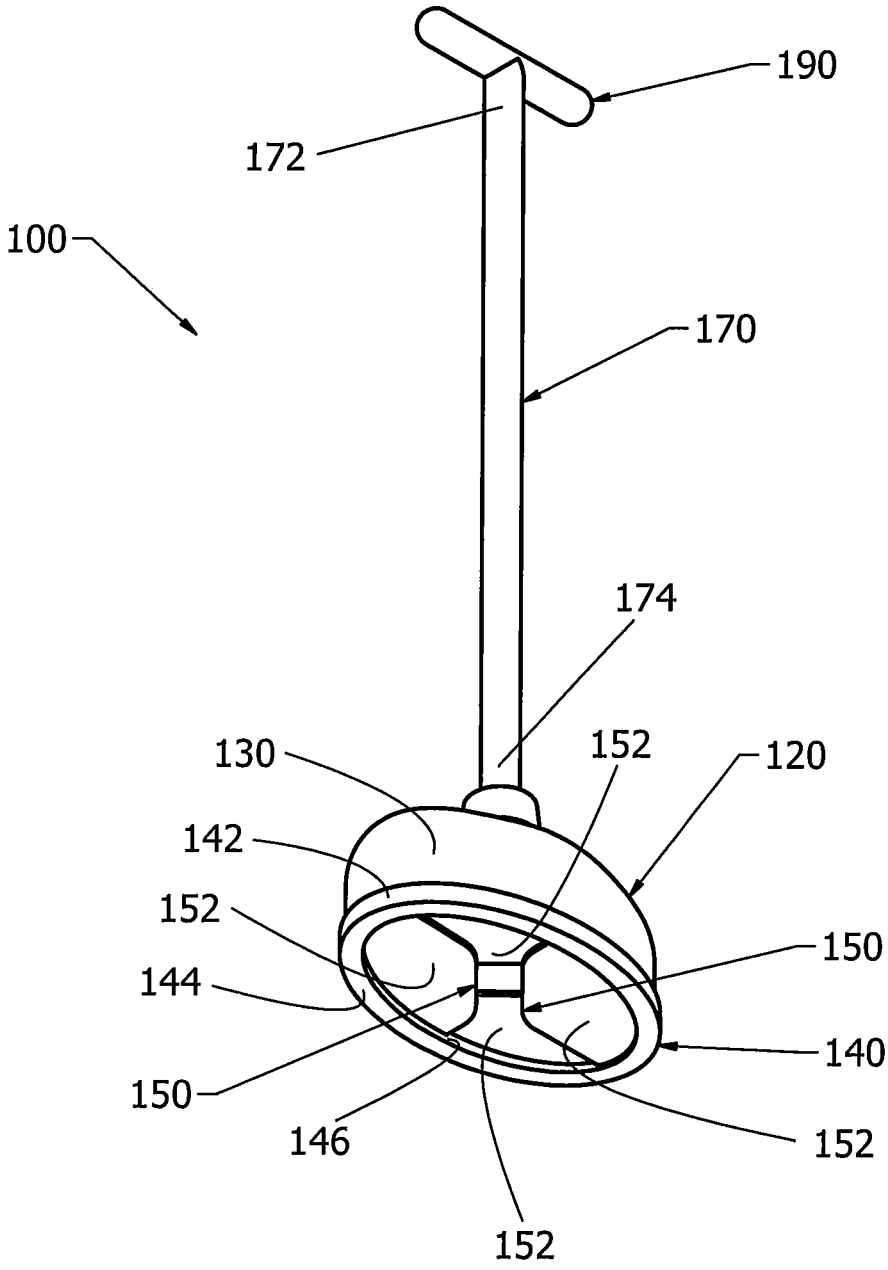
FIG. 3 illustrates a perspective view of the improved plunger device depicted in FIG. 1.

Referring initially to the drawings, FIG. 1 illustrates one embodiment of the plunger device 100 of the present invention which is preferably comprised of a bell 120, a stem 170 and a handle 190. As depicted in FIGS. 2 and 3, bell 120 is preferably comprised of a dome 130, a base 140 that is either part of or attached to dome 130, an optional at least one baffle 150, and a bell opening 160. Unless otherwise stated, each of dome 130, base 140, and at least one baffle 150 is preferably comprised of rubber, though it is also contemplated that other flexible materials could be used such as silicone, deformable plastic or the like, without affecting the overall concept of the present invention.

As previously stated, dome 130 and base 140 can be integrally formed as a single unit, or base 140 can be separately formed and attached to dome 130 by any means commonly known in the art for attaching a plunger base to a plunger dome. Base 140 further comprises an outer surface 142, a bottom surface 144 and an inner surface 146, the purposes of which are described more fully below.

Figure 5:
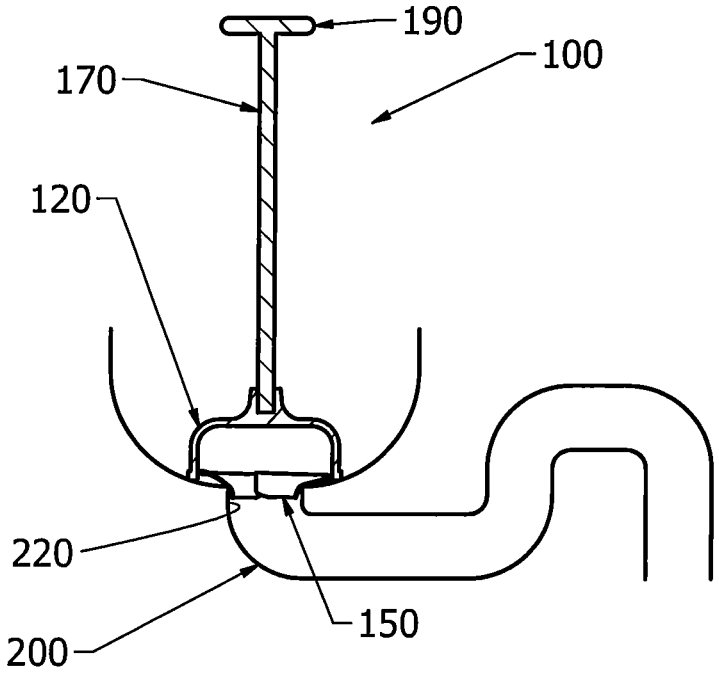
FIG. 5 illustrates a front elevational and cross-sectional view of the improved plunger device depicted in FIG. 1 placed over an older style toilet drain.

Dome 130, base 140 and bell opening 160 are somewhat similar in general structure and function to the plungers of the prior art, with the exception that instead of bell 120 and bell opening 160 having a generally circular shape as in the case of a prior art plunger, bell 120, dome 130, base 140 and bell opening 160 of the present invention each have a generally oblong shape to better accommodate the trough-like nature of most modern day toilet drains as described more fully below and shown in FIG. 5. By stating that the shape is generally oblong, applicant means that the radius of bell opening 160, as measured from the center point of bell opening 160 to the outer surface 142 of base 140 is not uniform along the entire outer surface 142 of base 140. For example, it is contemplated that the radius of bell opening 160 at its widest portion is between 3 and 5 inches wide, and the radius at the narrowest portion is between 2 and 4 inches wide. It is also contemplated that the depth of dome 130 is between 2 and 4 inches, as measured between the top of bell 120 (i.e., where the bell 120 meets stem 170) and the centerline of the plane created by bottom surface 144 of base 140. Notwithstanding, it is contemplated that different sized bells 120 can also be used without affecting the overall concept of the present invention, and the forgoing preferred dimensional ranges should not be interpreted as limitations.

As discussed below and depicted in FIG. 5, the plunger device 100 of the present invention is also effective when applied to conventional toilet drains. The volume of dome 130 is generally in the range of 55 to 70 cubic inches, which is larger than prior art plunger domes whose volume typically ranges from 25 to 40 cubic inches, though it is also contemplated that other sized domes could be used without impacting the overall concept of the present invention.

Figure 4:
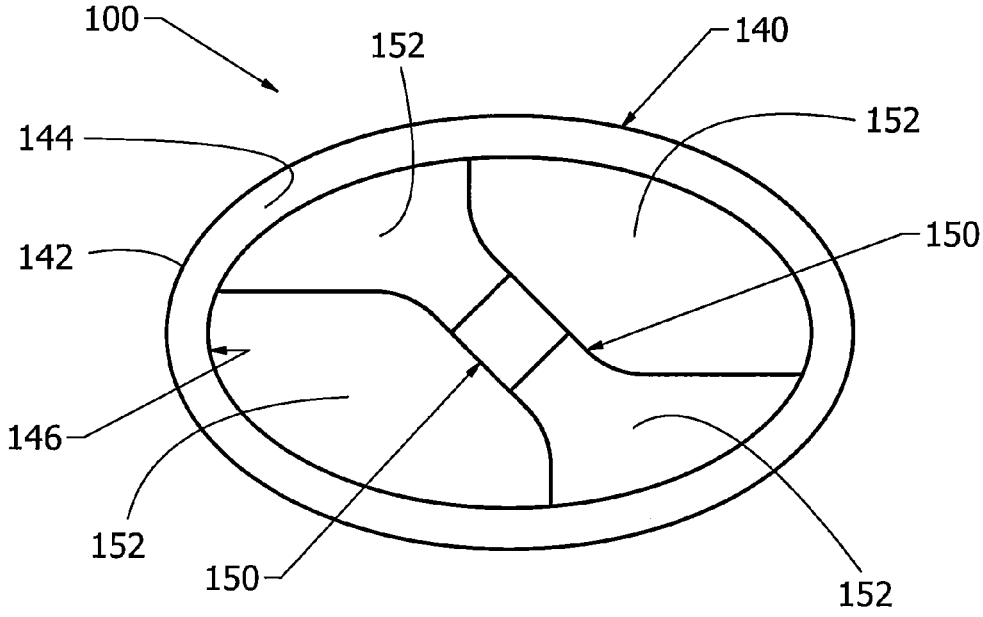
FIG. 4 illustrates a bottom view of the improved plunger device depicted in FIG. 1 with the baffles in a closed position.
Figure 4A:
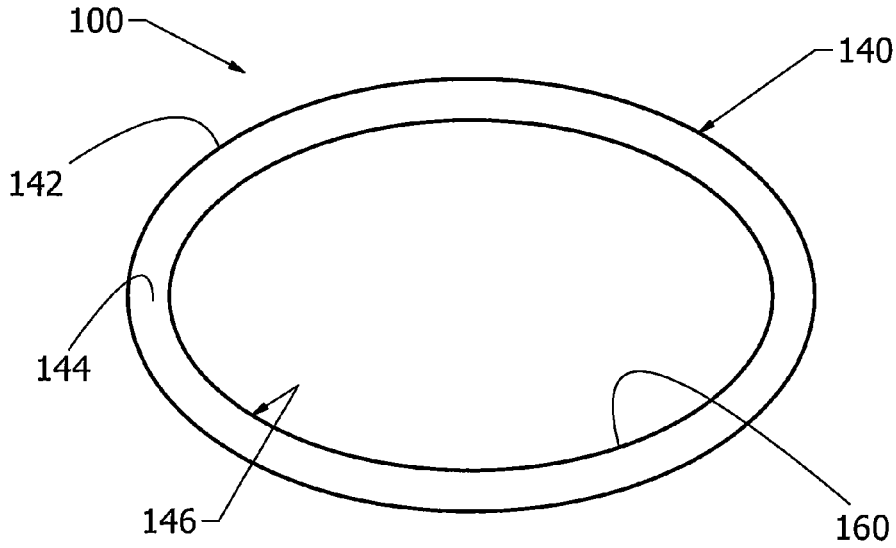
FIG. 4A illustrates a bottom view of another embodiment of the improved plunger device of the present invention without baffles.

An additional distinguishing feature between known plunger devices and the plunger device 100 of the present invention is that bell 120 preferably further comprises at least one baffle 150 and, more preferably, a plurality of baffles 150, as best illustrated in FIGS. 3 and 4. More specifically, baffles 150 are tab- or flap-like structures further comprised of an exterior surface 152. Baffles 150 preferably extend from the inner surface 146 of base 140 towards the center of bell opening 160, as best shown in FIG. 4, when baffles 150 are in a closed position. Each of baffles 150 is generally semi-circular shaped and measure approximately 2 to 4 inches long by 4 to 6 inches wide, though it is also contemplated that other size and shaped baffles could also be used without impacting the overall concept of the present invention. Baffles 150 may also partially overlap one another when in the closed position, and may generally abut one another when in the open position and in use, as described more fully below.

It is also contemplated that baffles 150 can extend from the interior portion of dome 130 toward the center of bell opening 160 when in the closed position without affecting the overall concept of the present invention. Baffles 150 are preferably integrally formed as a single unit with dome 130 and/or base 140. When plunger device is in an upright position, gravity causes baffles 150 to be in an open position, meaning that one or more baffles 150 extend downward from inner surface 146 and below bottom surface 144 of base 140. Additionally, when plunger device 100 is used, the force of air/water being expelled from the bell 120 will also cause baffles 150 to move to an open position as described more fully below.

FIG. 5 illustrates one embodiment of the plunger device 100 of the present invention being used in connection with a graphical representation of a conventional toilet drain 200 with a conventional, generally circular drain opening 220. More specifically, when bell 120 is positioned over drain opening 220, baffles 150 extend downward from inner surface 146, below bottom surface 144 of base 140, and into drain opening 220, thereby helping to create a seal between plunger device 100 and drain 200 and increase the effectiveness of plunger device 100. Moreover, the generally oblong shape of bell 120 and bell opening 160, combined with the presence of baffles 150, also helps to reduce the likelihood of splash back occurring, which is a common problem with prior art plunger devices.

Figure 5A:
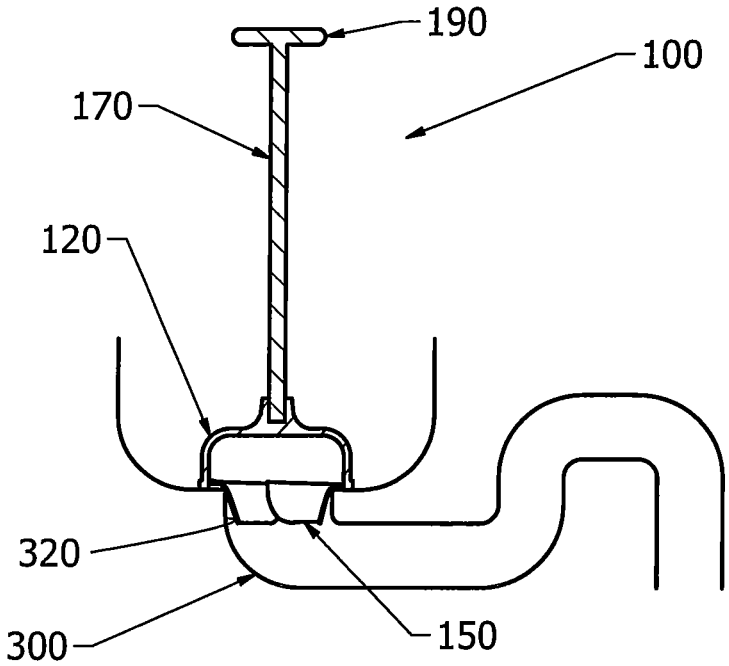
FIG. 5A illustrates a front elevational and cross-sectional view of the improved plunger device depicted in FIG. 1 placed over a modern style trough-like toilet drain.

FIG. 5A illustrates one embodiment of the plunger device 100 of the present invention being used in connection with a graphical representation of a modern toilet drain 300 with a modern, generally oblong or trough-like drain opening 320. More specifically, when bell 120 is positioned over drain opening 320 such that the generally oblong shape of bell opening 160 covers drain opening or trough 320, baffles 150 extend downward from inner surface 146, below bottom surface 144 of base 140, and into drain opening 320, thereby helping to create a seal between plunger device 100 and drain 300 and increase the effectiveness of plunger device 100. The generally oblong shape of bell 120 and bell opening 160, combined with the presence of baffles 150, also helps to reduce the likelihood of splash back occurring, which is a common problem with prior art plunger devices.

As previously mentioned, plunger device 100 further comprises a stem 170. Stem 170 is well known in the art with respect to prior art plunger devices and is preferably comprised of an elongated member with a first end 172 and a second end 174, as depicted in the FIGS. A user (not shown) can use the first end 172 of stem 170 to manipulate the plunger device 100 of the present invention, as described more fully below. The bell 120 is typically attached to the second end 174 of the stem 170, though it is also contemplated that the arrangement could be reversed such that the bell 120 is attached to the first end 172, and the second end 174 of the stem is used to operate the plunger device 100. In either instance, bell 120 is attached to stem 170 in any matter commonly known in the art, and stem 170 is preferably comprised of wood, metal or plastic, though it is contemplated that other durable materials could also be used without affecting the overall concept of the present invention.

As previously mentioned, plunger device 100 may further comprise a toggle or handle 190 attached to the end 172 or 174, opposite of bell 120, as illustrated in the FIGS. Handle 190 and stem 170 can be formed as a single unit, or handle 190 can be attached to stem 170 by any means commonly known in the art for attaching a plunger handle to a plunger stem, such as with fasteners or glue. Handle 190 can be comprised of any durable material known in the art such as metal, wood or plastic, and helps to facilitate the use of plunger device 100 as more fully described below. Notwithstanding, it is also contemplated that plunger device 100 can function as intended without handle 190, and with the user manipulating plunger device 100 via stem 170.

Having now described the preferred embodiment of plunger device 100, its use and usefulness will now be described. A user (not shown) desiring to unclog a modern trough-like drain 300, such as the drain depicted in FIG. 5A, simply places the bell 120 of plunger device 100 over the clogged drain opening 320, thereby permitting the baffles 150 to extend downward from inner surface 146 or dome 130, and partially into drain opening 320. The user will then apply a generally downward (i.e., in the direction of the drain opening 320) pressure to the stem 170 or handle 190 in a manner commonly known to those in the art that use plungers to unclog toilet drains, causing the dome 130 to compress or collapse and expel the volume of air or water contained therein into drain opening 320 in an effort to unclog drain 300. As the air/water is expelled from the dome 130, it forces the exterior surface 152 of baffles 150 against the sides of the drain opening 320, thereby further sealing the connection between the device 100 and the drain 300 and reducing or eliminating the likelihood of splash-back.

After the dome 130 is collapsed, the user can pull upward (i.e., in a direction opposite the drain 300) on the stem 170 or handle 190, thereby creating a vacuum in the drain 300 that could also dislodge the clog (not shown). As the plunger device 100 is removed from the drain 300, the rubber or otherwise elastic dome 130 will resort to its original shape similar as to with prior art generally circular plungers. As with prior art plungers, these motions (i.e., downward and then upward) can also be repeated multiple times until the drain 300 is unclogged. Importantly, the generally oblong shape of the bell 120, dome 130, base 140 and bell opening 160, along with the presence of baffles 150, help to create a better seal between the plunger device 100 and the drain 300, thereby increasing the effectiveness of device 100 and avoiding or reducing the possibility of splash-back.

Other variations are within the spirit of the present invention. Thus, while the invention is susceptible to various modifications and alternative constructions, a certain illustrated embodiment thereof is shown in the drawings and has been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein. Variations of those preferred embodiments may become apparent to those of ordinary skill in the art upon reading the foregoing description. The inventor expects skilled artisans to employ such variations as appropriate, and the inventor intends for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A plunger device for unclogging a drain comprising:

a stem;

a collapsible bell for generating a drain clearing force wherein said collapsible bell further comprises a base with a bottom surface; and at least one baffle attached to said collapsible bell for sealing the plunger device against a drain configuration, wherein said at least one baffle is capable of dropping below said collapsible bell and further wherein said at least one baffle is capable of rotating below said base.

2. The plunger device of claim 1 wherein said collapsible bell further comprises a generally oblong opening.

3. The plunger device of claim 1 wherein said collapsible bell is comprised of rubber.

4. The plunger device of claim 1 wherein said at least one baffle is comprised of rubber.

5. The plunger device of claim 1 wherein said stem is comprised of at least one of the following: wood, metal or plastic.

6. The plunger device of claim 1 wherein said plunger device further comprises a handle.

7. A plunger device comprising:

a stem;

a bell attached to said stem and comprised of a collapsible dome for generating a drain clearing force, a base with a bottom surface and an oblong opening; and at least one baffle attached to said base for sealing the plunger device against a drain configuration, wherein said at least one baffle is capable of rotating below said base.

8. The plunger device of claim 7 wherein said bell is comprised of rubber.

9. The plunger device of claim 7 wherein said at least one baffle is capable of dropping below said base.

10. The plunger device of claim 9 wherein said at least one baffle is capable of dropping below said base and at least partially into a drain opening.

11. The plunger device of claim 7 wherein said at least one baffle is comprised of rubber.

12. The plunger device of claim 7 wherein said stem is comprised of at least one of the following: wood, metal or plastic.

13. The plunger device of claim 7 further comprising a handle.

14. A plunger device comprising:

a stem; and a collapsible bell with a generally oblong opening for generating a drain clearing force, wherein said collapsible bell further comprises a base with a bottom surface and at least one baffle attached to said base, wherein said at least one baffle is capable of rotating below said base.

15. The plunger device of claim 14 wherein said collapsible bell is comprised of rubber.

16. The plunger device of claim 14 wherein said at least one baffle is comprised of rubber.

17. The plunger device of claim 14 wherein said stem is comprised of at least one of the following: wood, metal or plastic.

18. The plunger device of claim 14 further comprising a handle.

* * * * *